US007089911B2

(12) United States Patent
Bender et al.

(10) Patent No.: US 7,089,911 B2
(45) Date of Patent: Aug. 15, 2006

(54) THROTTLE BODY AND ELECTRONIC MODULE

(75) Inventors: Guenther Bender, Rodheim (DE); Thomas Bluemel, Schmitten (DE); Thomas Hannewald, Griesheim (DE); Joerg Krueger, Frankfurt (DE); Rainer Montigny, Bad Soden (DE); Erwin Schneider, Liederbach (DE); Reiner Weingaertner, Lappersdorf (DE); Heinz-Werner Wiezorek, Eppstein (DE)

(73) Assignee: Siemens AG, München (DE)

( * ) Notice: Subject to any disclaimer, the term of this patent is extended or adjusted under 35 U.S.C. 154(b) by 145 days.

(21) Appl. No.: 10/678,224

(22) Filed: Oct. 6, 2003

(65) Prior Publication Data

US 2004/0094121 A1 May 20, 2004

Related U.S. Application Data

(63) Continuation of application No. PCT/DE02/01058, filed on Mar. 22, 2002.

(30) Foreign Application Priority Data

Apr. 7, 2001 (DE) ..... 101 17 542

(51) Int. Cl.
*F02D 9/10* (2006.01)

(52) U.S. Cl. ..... 123/399; 123/337

(58) Field of Classification Search ..... 123/337, 123/399

See application file for complete search history.

(56) References Cited

U.S. PATENT DOCUMENTS 4,561,396 A * 12/1985 Sakamoto et al. ..... 123/198 E
4,840,349 A 6/1989 Peter et al.
4,926,821 A * 5/1990 Porth et al. ..... 123/399
5,482,019 A 1/1996 Ausiello et al.
5,718,202 A 2/1998 Bentz et al.
6,347,613 B1 * 2/2002 Rauch ..... 123/337
6,390,062 B1 * 5/2002 Saito et al. ..... 123/399
6,557,523 B1 * 5/2003 Bos et al. ..... 123/337
6,866,027 B1 * 3/2005 Marchesini et al. ..... 123/337

FOREIGN PATENT DOCUMENTS

DE 44 43 502 A1 6/1996
DE 195 16 584 A1 11/1996

(Continued)

OTHER PUBLICATIONS

DE19719991A1—Derwent Abstract.
DE19516584A1-Derwent Abstract.

(Continued)

*Primary Examiner*—Erick R Solis
(74) *Attorney, Agent, or Firm*—Siemens AG

(57) ABSTRACT

The present invention relates to a throttle-valve housing having a continuous throttle opening for a throttle-valve which is arranged on a throttle-valve shaft, and a housing having a housing cover and a housing body. An electric drive and a first electronic mechanism for the drive are arranged in the housing, for displacing the throttle-valve shaft. The throttle-valve housing is especially non-complex in terms of production and assembly, and can be especially easily connected to other electronic mechanisms of the motor vehicle. To this end, the first electronic mechanism for the electric drive and the second electronic mechanism for appliances outside the housing are arranged in the cover of the housing. Both the first electronic mechanism of the electric drive for the throttle-valve shaft and the second electronic mechanism for the electrical appliances, can be brought into contact with the electrical appliances outside the housing by means of electrical connections which are at least partially arranged in the cover of the housing.

21 Claims, 3 Drawing Sheets

FOREIGN PATENT DOCUMENTS

| | | | |
|---|---|---|---|
| DE | 197 19 991 | A1 | 11/1998 |
| EP | 0 844 378 | A2 | 5/1998 |
| EP | 0 989 292 | A2 | 3/2000 |
| EP | 1024 270 | A2 | 8/2000 |

OTHER PUBLICATIONS

DE4443502A1-Derwent Abstract.
EP0989292A2-Derwent Abstract.

* cited by examiner

THROTTLE BODY AND ELECTRONIC MODULE

CROSS REFERENCE TO RELATED APPLICATIONS

The present invention is a continuation of international application PCT/DE02/01058, which designated the United States and was filed 22 Mar. 2002, and further claims priority to priority document DE10117542.6, filed on 7 Apr. 2001, the both of which are herein incorporated by reference.

BACKGROUND OF THE INVENTION

The invention relates to a throttle body, in particular for an internal combustion engine of a motor vehicle, with a continuous throttle opening for a throttle valve which is pivotably arranged on a throttle-valve shaft and with a housing, the housing comprising a housing cover and a housing body, an electric servodrive and a first electronic mechanism being arranged in the housing for pivoting the throttle-valve shaft. The invention also relates to an electronic module, which comprises electronic mechanisms for a motor vehicle and a base element which can be closed by a cover element, the motor vehicle having a multiplicity of electrical appliances and a throttle body, the throttle body comprising a housing with a continuous throttle opening for a throttle valve which is pivotably arranged on a throttle-valve shaft and an electric servodrive, arranged in the housing, for pivoting the throttle-valve shaft.

To control the amount of fresh gas to be fed to the internal combustion engine of a motor vehicle, throttle bodies are usually used. Throttle bodies comprise a housing with a continuous throttle opening and a throttle member arranged in the throttle opening. The throttle member assumes a specific position in the throttle opening for a specific amount of fresh gas to be allowed to pass through. To this end, the throttle member can be mechanically or electronically activated.

It may be the case that, in a part-range, for example the idling range, the throttle valve of a throttle body can be moved by a servodrive and, in the remaining range, it can be moved with the aid of a wire cable coupled to the gas pedal of the motor vehicle. Alternatively, however, it may also be the case that the throttle valve can be moved by a servodrive in its entire adjusting range. In the case of these last-mentioned systems, there is no mechanical connection between the set point input, in particular the gas pedal, and the throttle valve. In the case of these electronic gas-pedal or drive-by-wire systems as they are known, the power requirement is converted into an electrical signal when initiated by the pressing down of the gas pedal. The electrical signal is fed to a control unit, which in turn generates from the electrical signal an activation signal for the servodrive.

In order in the case of electronic gas-pedal systems to avoid errors in the transmission of the activation signal from the control unit for driving the throttle-valve shaft, there are throttle bodies in which the control unit for the servodrive is integrated into the housing of the throttle body. The control unit may in this case be integrated into an electronic mechanism arranged in the housing. The electronic mechanism is in this case intended for further functions of the throttle body, for example for the activation of a position control of the throttle-valve shaft and the acquisition and storage of data of the throttle body. Integration of an electronic mechanism into the housing of the throttle body is often particularly complex in terms of production and assembly, since the housing must additionally have a receptacle for the electronic mechanism. What is more, the assembly of the throttle body requires an additional assembly step, in which the electronic mechanism is integrated into the housing of the throttle body.

Even if transmission errors of the activation signal of the servodrive for the throttle valve can be avoided particularly reliably by integrating the electronic mechanism for the throttle body into the housing of the throttle body, it may however prove to be problematical to connect the electronic mechanism of the throttle body to the remaining electronic mechanisms of the motor vehicle. A connection of the electronic mechanism of the throttle body to the remaining electronic mechanisms of the motor vehicle is required in order, for example, to coordinate the position of the throttle valve with the operation of an ignition device and/or an injection device. This connection of the electronic mechanism of the throttle body to other electronic mechanisms, in particular electronic control mechanisms, of the motor vehicle involves particularly great complexity in terms of assembly for the installation of the throttle body or electronic gas-pedal system in a motor vehicle. The further electrical appliances activated by the other electronic mechanisms of the motor vehicle may in this case be arranged both inside and outside the internal combustion engine in the motor vehicle. Furthermore, the signals to be exchanged between the electronic mechanism of the throttle body and the other electronic mechanisms may be falsified on account of interference pulses, possibly resulting in faulty signal transmission or, in the extreme case, no transmission at all. Furthermore, each cable to be laid in the motor vehicle represents additional complexity in terms of assembly.

SUMMARY OF THE INVENTION

The invention is therefore based on an object of providing a throttle body of the type stated at the beginning with an electronic mechanism which can be connected especially easily to other electronic mechanisms of the motor vehicle in a way which is especially non-complex in terms of production and assembly. It is also intended to provide a housing for the electronic mechanism of the type stated above which can be arranged in the motor vehicle in a way which is especially non-complex in terms of production and assembly, in particular in the engine compartment.

This and other objects are achieved according to the invention with respect to the throttle body by arranging the first electronic mechanism of the throttle body and a second electronic mechanism for a number of electrical appliances arranged outside the housing together in the housing cover of the throttle body, it being possible for both the first electronic mechanism of the throttle body and the second electronic mechanism of the electrical appliances to be brought into contact with the electrical appliances arranged outside the housing by means of electrical connection means which are at least partially arranged in the housing cover.

The invention is based in this respect on the consideration that a throttle body which is to be created in a way which is especially non-complex in terms of production and assembly can be connected especially easily to other electronic mechanisms of the motor vehicle if the electrical connection lines from the throttle body to these other electronic mechanisms are made to be particularly short. Since, however, the sensor systems of the motor vehicle, in particular of the internal combustion engine, must be arranged at specific locations in the motor vehicle, in order for example to acquire specific data such as an oil temperature and/or an oil level, the remaining electronic mechanisms of the motor vehicle cannot necessarily be arranged in the direct vicinity of the throttle body. The arrangement of the other electronic mechanisms of the motor vehicle at locations other than that of the throttle body may, however, lead to errors in the signal transmission. Faulty transmission of the signals to be transmitted can be avoided particularly well if a central acquisition, storage, evaluation, open-loop and/or closed-loop control unit is provided. All the data acquired then come together in this central unit and are prepared in such a way that the corresponding control signals can be reliably transmitted to the electrical appliances. If in this case this central unit is integrated into one of the electrical appliances or into the throttle body, faulty transmission can be avoided especially well, at least for the specific device in which the central unit is arranged.

Since the acquisition, evaluation, closed-loop and/or open-loop electronic mechanism required for the drive of the throttle valve of the throttle body is already integrated into the throttle body, a further central unit, which communicates with further electrical appliances of the internal combustion engine, could be arranged in the throttle body, In this case, however, the throttle body should not have outer dimensions that are any greater than before, for reasons of space. Moreover, the throttle body should be especially non-complex in terms of production and assembly. To this end, both the first electronic mechanism for the electric drive and the second electronic mechanism for a number of electrical appliances of the motor vehicle are arranged directly on the housing cover of the housing of the throttle body. In order in this case to ensure at the same time especially easy contacting of the first and the second electronic mechanisms with further electrical appliances of the motor vehicle, both the first electronic mechanism and the second electronic mechanism can be brought into contact with electrical appliances arranged outside the housing of the throttle body by means of electrical connection means which are arranged in the housing cover.

The electrical appliances are advantageously arranged in an internal combustion engine of a motor vehicle. A throttle body is a conventional component for a motor vehicle, which is often arranged outside the internal combustion engine. In just the same way as the throttle body, the further electrical appliances of the internal combustion engine of the motor vehicle need a central unit, by means of which data can be read in from electrical appliances of the internal combustion engine and by means of which control signals can be output to the electrical, appliances of the internal combustion engine. Arrangement of both the first electronic mechanism for the throttle body and the second electronic mechanism for other electrical appliances together, centrally in the housing cover of the throttle body, ensures a compact type of construction of the electronic mechanisms of the motor vehicle, whereby the production and assembly costs for the electronic mechanisms of the motor vehicle concerned are especially low.

The electronic mechanism for the electrical appliances arranged outside the housing of the throttle body advantageously comprises a control unit, a data acquisition unit and a data storage unit. These three units ensure especially reliable and easy acquisition and storage of data of the electrical appliances, it being possible for activation of one or more electrical appliances to be performed by means of acquired or stored data.

The electrical appliances are advantageously an ignition device and/or an injection device and/or an oil-level measuring device and/or an air-mass regulating device. In addition or alternatively, the electrical appliances may also be electronic engine-control mechanisms and/or an electromechanically integrated throttle body. These electrical appliances directly control the combustion of the fuel in the internal combustion engine and are therefore in a direct relationship with the position of the throttle valve in the throttle opening of the throttle body. Therefore, in particular in the case of the said electrical appliances, the electronic reading-out, open-loop and/or closed-loop control mechanisms should be arranged in the throttle body together with the electronic mechanism for the throttle body.

The housing cover advantageously consists of plastic, the electrical connection means being at least partially embedded in the plastic. Integration of the electrical connection means into the plastic also reduces the complexity in terns of assembly of the throttle body, since it only remains for the electrical connection means integrated into the housing cover to be connected to the first and/or second electronic mechanism of the housing cover. The electrical connection means may, for example, be integrated into the housing cover by being injection-molded into the plastic during the production of the housing cover by the injection-molding process. Alternatively, the housing cover may, however, also be produced from a metal-containing plastic or else entirely from metal. When the housing cover is produced from metal, for example aluminum, however, the electrical connection means must be subsequently placed into the housing cover and additionally insulated, in order to avoid an electrical short-circuit with respect to the housing cover. This involves additional complexity in terms of assembly, which proves to be uneconomical in the production of the throttle body.

Both the first electronic mechanism for the throttle body and the second electronic mechanism for the electrical appliances arranged outside the housing are advantageously arranged in a region of the housing cover which is bounded by a covering element. This covering element may in this case be produced from metal, plastic or ceramic. The covering element separates the first electronic mechanism and the second electronic mechanism especially reliably from the remaining interior region of the housing of the throttle body. This separation prevents any ingress of foreign particles from the remaining interior region of the housing of the throttle body into the first electronic mechanism and into the second electronic mechanism especially reliably.

The first electronic mechanism for the throttle body and the second electronic mechanism for the electrical appliances arranged outside the housing of the throttle body are advantageously arranged on a common printed circuit board in the housing cover of the housing of the throttle body. The arrangement of the first electronic mechanism and the second electronic mechanism together on a common printed circuit board is especially non-complex in terms of production both for the first electronic mechanism and for the second electronic mechanism, since they can be brought onto a printed circuit board together in one production process. Moreover, the throttle body is made less complex to assemble, since only a single printed circuit board has to be fitted into the housing cover of the housing of the throttle body.

The printed circuit board is advantageously arranged on a heat-conducting plate, in particular a metallic plate. The arrangement of the printed circuit board on a heat-conducting plate ensures especially reliably that heat of the electronic mechanism produced during the operation of the throttle body can be reliably dissipated from the housing of the throttle body over the especially large surface area of the heat-conducting plate. As a result, given a suitable design of the heat-conducting plate, excessive heating-up of the electronic mechanism is reliably prevented. Excessive heating-up of the electronic mechanism should be avoidable, in order for damage to the electronic mechanism or, in the extreme case, complete failure of the electronic mechanism to be reliably prevented. Since the housing cover of the housing of the throttle body is generally produced from plastic and not from metal for cost reasons, it cannot usually dissipate the heat. The heat-conducting plate provides a means of easily ensuring that the heat produced by the electronic mechanism during the operation of the throttle body can be dissipated from the region of the electronic mechanism.

The heat-conducting plate, in particular metallic plate, is advantageously fastened by means for fastening both on the housing cover and on the housing body. Fastening of the heat-conducting plate advantageously takes place in this case by screws which predominantly consist of metal. The heat of the heat-conducting plate can then be transferred via the screws to the housing body, which consequently represents a heat sink. As a result, overheating of the electronic mechanism arranged in the housing cover of the throttle body is avoided especially reliably.

The housing body advantageously consists predominantly of metal, in particular aluminum. A housing body produced from metal conducts the heat transferred to it by means of the screws away to the outside especially well, whereby overheating of the electronic mechanism is additionally avoided especially reliably. Aluminum in this case offers the advantage that it can be processed especially easily by the injection-molding process.

The electric servodrive of the throttle-valve shaft is advantageously connected to the first electronic mechanism of the throttle body by means of an electrical plug-in connection. The electric servodrive can be brought into contact with the electronic mechanism especially easily by means of an electrical plug-in connection. As a result, the connection of the first electronic mechanism to the electric servodrive is especially non-complex in terms of assembly.

A restoring spring device for resetting the throttle valve into a starting position is advantageously arranged in the housing. This restoring spring device ensures in the event of a failure of the electric servodrive of the throttle-valve shaft that the throttle valve can be reset into a starting position even without the electric servodrive. In this case, this starting position is often not the closed position of the throttle valve but a position with a small opening angle of the throttle valve, in order to ensure that the driver of the motor vehicle can still reach a repair workshop even in the event of failure of the electric servodrive of the throttle-valve shaft.

A device for acquiring the position of the throttle-valve shaft is advantageously arranged in the housing. This device for acquiring the position of the throttle-valve shaft ensures that, given appropriate activation of the electric drive of the throttle-valve shaft, the latter is also brought into a well-defined position. If a signal of the device for acquiring the position of the throttle-valve shaft indicates that the latter does not assume the desired position in spite of proper electrical activation, an error signal is produced, signaling to the driver of the motor vehicle that the gas pedal is not functioning properly.

The object is achieved according to the invention with respect to the electronic module by a first electronic mechanism for the throttle body and a second electronic mechanism for a number of electrical appliances of the motor vehicle being arranged in the cover element, it being possible for the first electronic mechanism of the throttle body and the second electronic mechanism of the electrical appliances to be connected to the electrical devices of the throttle body and the electrical appliances of the motor vehicle by means of electrical connection means, the connection means being at least partially arranged in the cover element.

The invention is based in this respect on the consideration that the electronic mechanism for a motor vehicle can be divided into the electronic mechanism of the throttle body and a second electronic mechanism for the other electrical appliances of the motor vehicle. In order for transmission errors of coupling signals between the first electronic mechanism of the throttle body and the second electronic mechanism of the other electrical appliances of the motor vehicle to be reliably avoided, the first electronic mechanism for the throttle body and the second electronic mechanism for the multiplicity of electrical appliances of the motor vehicle should be arranged close together. The first electronic mechanism and the second electronic mechanism can be arranged especially close together if they are combined in a common electronic module, In this case, the assembly of the electronic module proves to be especially non-complex, since only a single module has to be fitted in the motor vehicle instead of a first electronic mechanism for the throttle body and a second electronic mechanism for the multiplicity of electrical appliances of the motor vehicle. Moreover, an electronic module which combines the first electronic mechanism for the throttle body with the second electronic mechanism of the other electrical appliances of the motor vehicle offers the advantage that this electronic module can be arranged anywhere in the motor vehicle, and consequently the electronic module can also be fitted in what are known as dead angles.

The electrical appliances are advantageously an ignition device and/or an injection device and/or an oil-level measuring device and/or an air-mass regulating device. These electrical appliances are in a relationship with the position of the throttle valve in the throttle body and therefore, to avoid transmission errors, should have an electronic mechanism which is arranged in the direct vicinity of the first electronic mechanism of the throttle body.

The housing cover is advantageously produced from plastic, the electrical connection means being at least partially embedded in the plastic. If, for example, the housing cover is produced from plastic by the injection-molding process, the electrical connection means can already be embedded in the plastic during the injection-molding operation. As a result, the cover element is especially non-complex in terms of production.

The first electronic mechanism for the throttle body and the second electronic mechanism for the electrical appliances of the internal combustion engine are advantageously arranged on a common printed circuit board in the cover element, A common printed circuit board for the first electronic mechanism of the throttle body and the second electronic mechanism of the electrical appliances of the motor vehicle makes it possible for the first electronic mechanism and the second electronic mechanism to be applied to the printed circuit board in a single production step, making production of the printed circuit board especially non-complex.

The printed circuit board is advantageously arranged on a heat-conducting plate, in particular a metallic plate. On account of being easy to work, aluminum is suitable as the metal. Since the housing cover will generally be produced from plastic for cost reasons, it is ensured by means of the heat-conducting plates that the heat produced during the operation of the throttle body is transported away from the electronic mechanism especially well by means of the heat-conducting plate.

The heat-conducting plate, in particular metallic plate, is advantageously fastened by means for fastening both on the cover element and on the base element. In this case, the means for fastening are advantageously screws which predominantly consist of metal. The screws can be used to establish a heat bridge to the base element, via which heat produced [lacuna] operation of the electronic mechanism can be dissipated especially easily.

The base element advantageously consists predominantly of metal, in particular of aluminum. The base element then dissipates the heat of the first electronic mechanism and the second electronic mechanism that has been transferred through the screws to the base element to the surroundings especially reliably, whereby excessive heating-up of the first electronic mechanism arranged on the printed circuit board and the second electronic mechanism is avoided especially reliably.

The advantages achieved with the invention are in particular that the integration of the electronic mechanisms required for the motor vehicle and the electronic mechanism for the throttle body in a single common printed circuit board and the arrangement in turn of this printed circuit board in the housing cover of the throttle body or in the electronic module have the effect of creating a central element that represents the heart of the electronic mechanisms of the motor vehicle. This central element, which can be arranged either in the housing of the throttle body or else as an electronic module anywhere in the motor vehicle, makes it possible for the entire electronic mechanisms of the motor vehicle to be arranged especially easily in the motor vehicle by means of a single assembly step. Particular flexibility of the arrangement is in this case obtained in particular if the electronic module is used. Even when there is a defect of the central element, only a single printed circuit board has to be investigated for defects and, if need be, can also be brought into a functional state again by exchanging it.

BRIEF DESCRIPTION OF THE SEVERAL VIEWS OF THE DRAWINGS

The novel features and method steps believed characteristic of the invention are set out in the claims below. The invention itself, however, as well as other features and advantages thereof, are best understood by reference to the detailed description, which follows, when read in conjunction with the accompanying drawing, wherein:

DETAILED DESCRIPTION OF THE INVENTION

Figure 1:
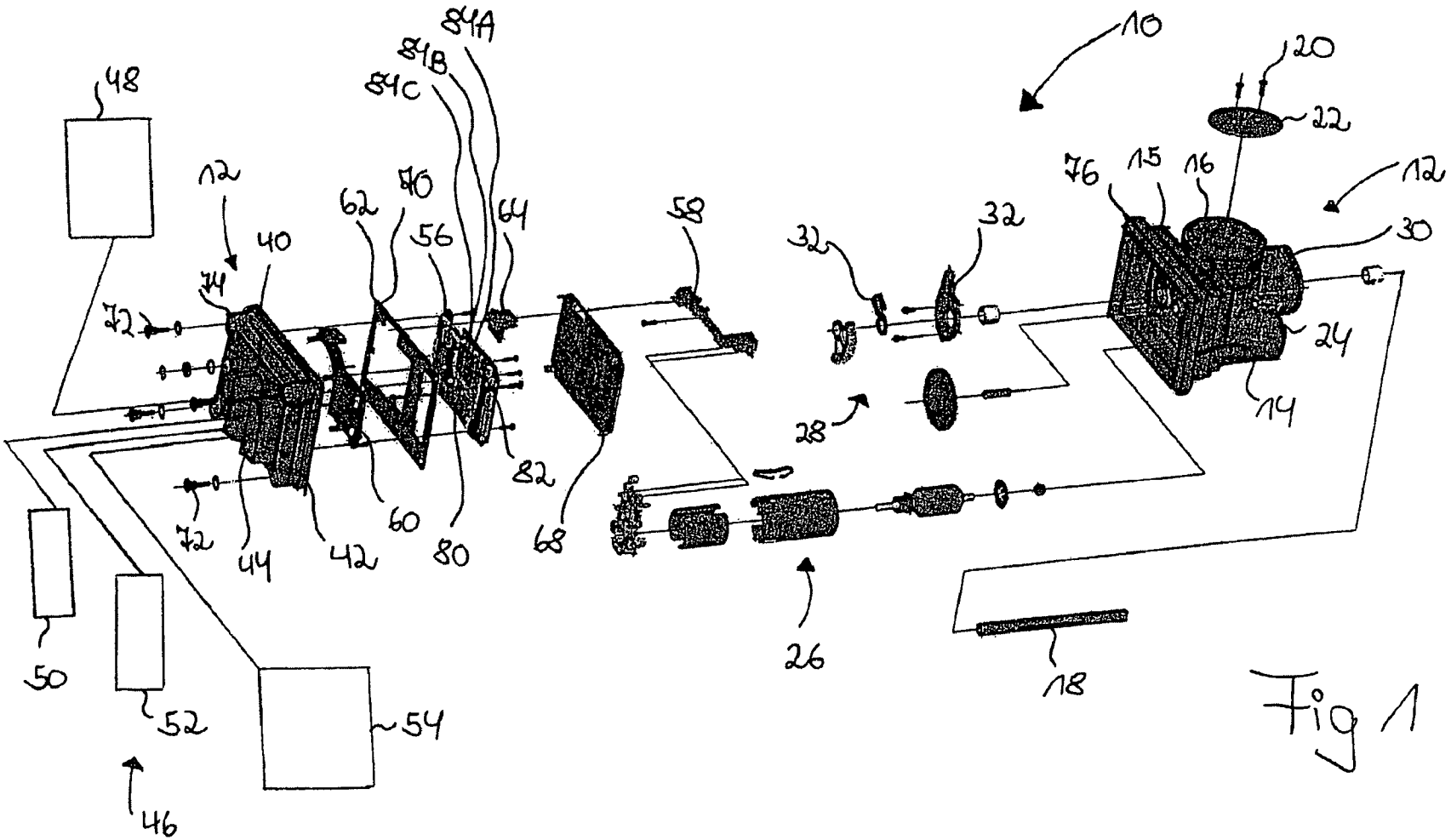
FIG. 1 shows a throttle body.

The throttle body 10 according to FIG. 1 serves for feeding an air or fuel/air mixture to a consumer not represented, for example an injection device, of a motor vehicle likewise not represented, the amount of fresh gas to be fed to the consumer being controllable by means of the throttle body 10. To this end, the throttle body 10 has a housing 12, which is produced predominantly from aluminum 14. Alternatively, however, the housing may also be produced from plastic, The housing 12 comprises a housing body 15, in which there is arranged a continuous throttle opening 16, via which air or a fuel/air mixture can be fed to the consumer not represented. For setting the volume of fresh gas to be fed, a throttle valve 22 is arranged on a throttle-valve shaft 18 with the aid of fastening means 20. The throttle-valve shaft 18, the fastening means 20 and the throttle valve 22 are depicted in FIG. 1 in an exploded representation.

Rotation of the throttle-valve shaft 18 at the same time brings about pivoting of the throttle valve 22 arranged on the throttle-valve shaft 18. Pivoting of the throttle valve 22 brings about an increase or decrease in the size of the opening of the throttle opening 16. As a result, the amount of flow medium passing through the throttle opening 16 can be set. Consequently, regulation of the throughput of the air or fuel/air mixture through the throttle opening 16 of the throttle body 10 takes place by means of a movement of the throttle valve 22.

The throttle-valve shaft 18 may be connected to a cable pulley (not represented in any more detail), which in turn is connected via a Bowden cable to a setting device for a power requirement, The setting device may in this case be designed as a gas pedal of a motor vehicle, so that, [lacuna] actuation of this setting device by the driver of the motor vehicle, the throttle valve 22 can be brought from a minimum opening position, in particular a closed position, into a maximum opening position, in particular an open position, in order in this way to control the power delivery of the motor vehicle.

In contrast to this, the throttle-valve shaft 18, shown in FIG. 1, of the throttle body 10 can be set either in a part-range by a servodrive and otherwise by means of the gas pedal, or else the throttle valve 22 can be set by a servodrive over the entire adjusting range. In the case of these electronic gas-pedal or drive-by-wire systems as they are known, the mechanical power control, for example pressing down of a gas pedal, is converted into an electrical signal. This signal is in turn fed to a control unit, which generates an activation signal for the servodrive. In the case of these systems, there is no mechanical coupling between the gas pedal and the throttle valve 22 in normal operation.

For adjusting the throttle-valve shaft 18, and consequently the throttle valve 22, the throttle body 10 therefore has a drive housing 24. The drive housing 24 is formed in one piece with the housing 12 of the throttle body 10. The housing 12 of the throttle body 10 and the drive housing 24 may alternatively also be formed in two pieces. Arranged in the drive housing 24 is an electric servodrive 26, designed as an electric motor. The electric servodrive 26, designed as an electric motor, is connected to the throttle-valve shaft 18 via a transmission 28. The throttle-valve shaft 18 is consequently able to be pivoted by the servodrive 26 designed as an electric motor.

The region of the housing 12 in which the servodrive 26 designed as an electric motor and the transmission 28 are arranged can be closed by a housing cover 40. The housing cover 40 is produced from plastic 42. Alternatively, however, the housing cover 40 may also be produced from metal, in particular aluminum. The housing cover 40 is produced from plastic 42 by the injection-molding process. In this case, electrical connection means 44 have been placed into the injection mold provided for the housing cover 40 and have been embedded at least partially into the plastic 42 during the injection-molding process, The throttle body 10 can be connected by means of the electrical connection means 44 to electrical appliances 46 which are arranged outside the throttle body 10. According to this exemplary embodiment, the electrical appliances, which are schematically indicated in FIG. 1, are an ignition device 48, an injection device 50, an oil-level measuring device 52 and an air-mass regulating device 54. Like the throttle body 10, the electrical appliances 46 are arranged in the internal combustion engine of the motor vehicle, neither the engine nor the motor vehicle being represented in any more detail in the drawing.

The electrical connection means 44 of the housing cover 40 are connected to the electric drive 26 by means of a printed circuit board 56 and an electrical plug-in connection 58, In this case, an electrical contact plate 60, which is arranged between the housing cover 40 and the printed circuit board 56, is provided for connecting the electrical connection means 44 of the housing cover 40 to the printed circuit board 56. Between the electrical contact plate 60 and the printed circuit board 56 there is also a metallic plate 62. The printed circuit board 56 is connected to the electrical plug-in connection 58 by means of an electrical contact 62. The electrical plug-in connection 58 engages in corresponding contacts 64 of the electric drive 26. To protect the printed circuit board 56 from contamination, which may be caused by the electric drive 26, the transmission 28 and the position acquisition means 32, a covering element 68 is used to separate the printed circuit board 56, the metallic plate 62 and also the contact plate 60 and the metallic plate 62 from the remaining housing region of the throttle body.

The covering element 68, the printed circuit board 56, the metallic plate 62 in each case have bores 70, via which they are to be arranged on the housing 12 of the throttle body 10 by means of fastening means 72 designed as metallic screws. To this end, the fastening means 72 designed as screws are inserted into openings 74 provided for this purpose in the housing cover. The fastening means 72 designed as screws are then passed through the metallic plate 62, the printed circuit board 56 and the covering element 68 and then engage in the thread 76 of the housing 12, in order to arrange the metallic plate 62, the printed circuit board 56 and the covering element 68 securely on the housing 12 of the throttle body 10. The fastening means 72 in this case do not serve exclusively as means for fastening but also dissipate heat produced in the printed circuit board 56 during operation of the throttle body 10 via the metallic plate 62 to the housing 12 of the throttle body 10.

Arranged on the printed circuit board 56 is a first electronic mechanism 80 for the electric drive 26 and a second electronic mechanism 82 for the electrical appliances 46 arranged outside the housing 12. Both the first electronic mechanism 80 and the second electronic mechanism 82 can be brought into contact with the electrical appliances 56 arranged outside the throttle body 10 by means of the electrical contact plate 60 and the connection means 44 which are at least partially arranged in the housing cover 40. The first electronic mechanism 80 and the second electronic mechanism 82 are applied in an integrated form of construction to the printed circuit board 56. Therefore, it cannot be decided from the outside which region of the printed circuit board 56 belongs to the first electronic mechanism 80 and which region of the printed circuit board belongs to the second electronic mechanism 82. Alternatively, however, the printed circuit board 46 may also have regions which can be clearly identified from the outside, provided for the first electronic mechanism 80 and the second electronic mechanism 82. The second electronic mechanism 82 for the appliances 46 arranged outside the housing 12 of the throttle body 10 comprises a control unit 84A, a data acquisition unit 84B and a data storage unit 84C, which are arranged together in an integrated way in a single module 84.

Figure 2:
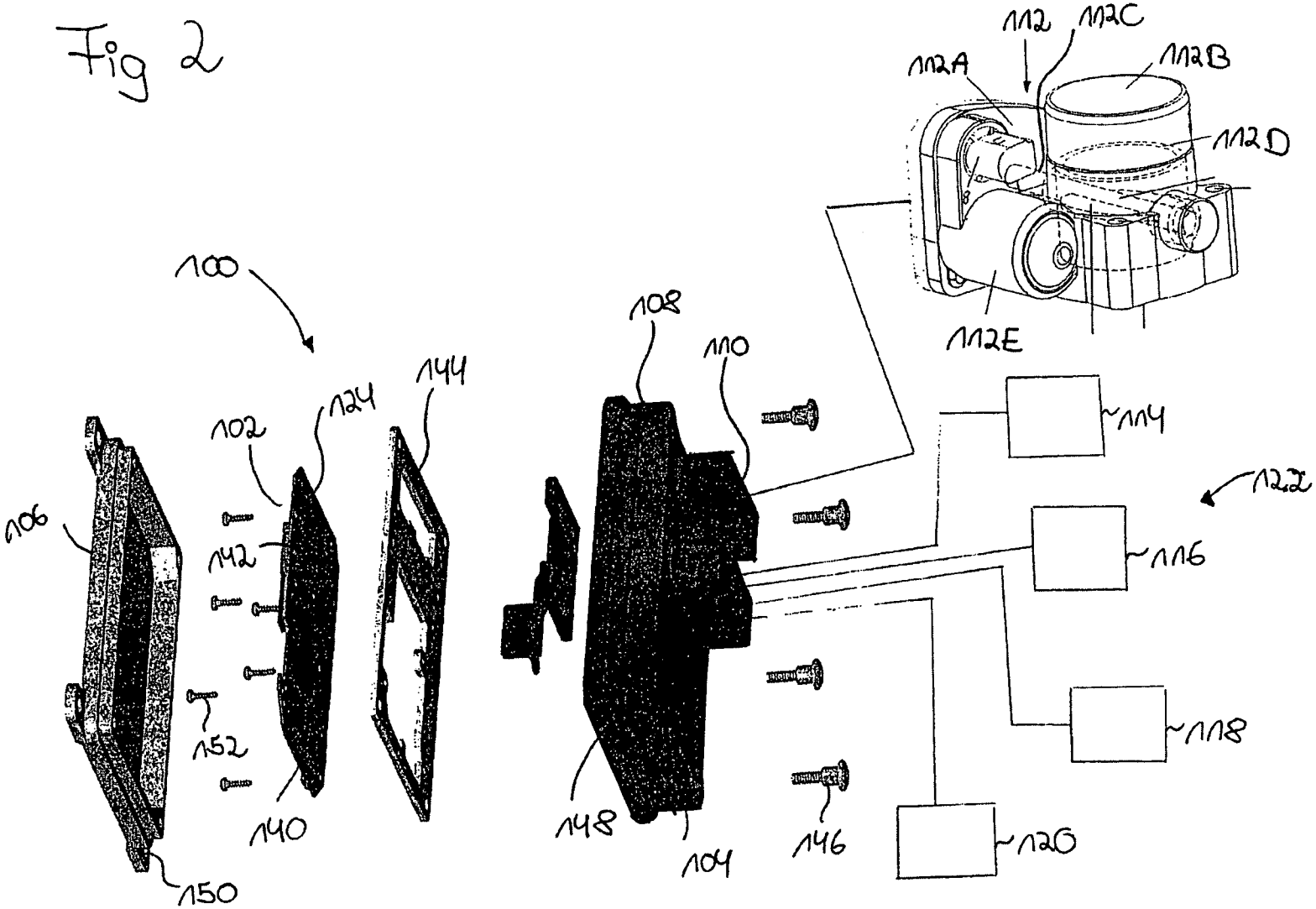
FIG. 2 shows the housing cover and electronic mechanism and also a plug-in connection.
Figure 3:
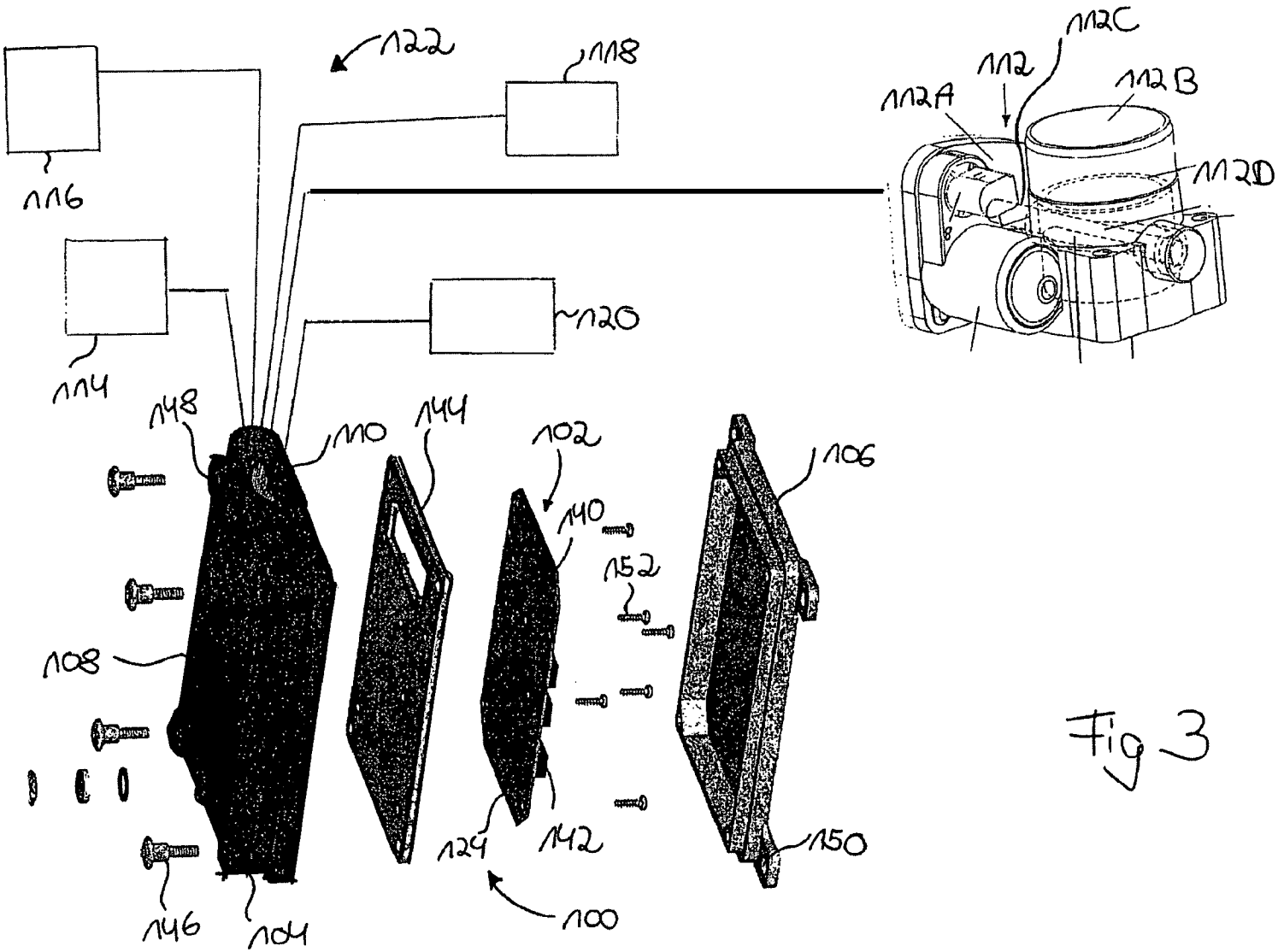
FIG. 3 shows an electronic module.

The electronic module 100 according to FIGS. 2 and 3 has an electronic mechanism 102 for a motor vehicle. The electronic module 100 comprises a base element 106, which can be closed by a cover element 104. The cover element 104 is produced from plastic 108. In this case, electrical connection means 110, which are at least partially enclosed completely by the plastic 108, have been integrated into the cover element 104 during the production process of the cover element 104. The electrical connection means 110 are used to connect the cover element 104 of the electronic module 100 to a throttle body 112, an ignition device 114, an injection device 116, an oil-level measuring device 118 and an air-mass regulating device 120. The electrical appliances 122 are arranged in the motor vehicle, the ignition device 114, the injection device 116, the oil-level measuring device 118 being arranged in the region of the internal combustion engine of the motor vehicle. Furthermore, the electronic module 100 is connected by means of the cover element 104 to a power source, which is not represented in any more detail in the drawing.

The throttle body 112 comprises a housing 112A with a continuous throttle opening 112B and a throttle valve 112D, which is pivotably arranged in the throttle opening 112B on a throttle-valve shaft 112C. Also arranged in the housing 112A of the throttle body 112 is an electric servodrive 112E for the pivoting of the throttle-valve shaft 112C.

A printed circuit board 124 is arranged in the cover element 104 of the electronic module 100. Arranged on the printed circuit board 124 is a first electronic mechanism 140 for the electric servodrive 112E of the throttle-valve shaft 112C of the throttle body 112 and a second electronic mechanism 142 for the multiplicity of electrical appliances 122. The first electronic mechanism 140 of the electric servodrive 112E of the throttle-valve shaft 112C and the second electronic mechanism for the multiplicity of electrical appliances 122 can be connected to the throttle body 112 and the electrical appliances 122 by means of the electrical connection means 110 arranged in the cover element 104. The first electronic mechanism 140 and the second electronic mechanism 142 are applied to the printed circuit board 124 in an integrated way. In this case, spatial regions in which the first electronic mechanism 140 and the second electronic mechanism 142 are arranged on the printed circuit board 124 cannot be specified on account of the integrated form of construction. Alternatively, the printed circuit board 124 may also be subdivided into regions which can be identified from the outside, in which the first electronic mechanism 140 and the second electronic mechanism 142 are arranged.

For removing the heat produced during the operation of the first electronic mechanism 140 and the second electronic mechanism 142, a metallic plate 144 is additionally arranged in the electronic module 100. The metallic plate 144 is to be arranged on the base element 106 by means of fastening means 146. To this end, the fastening means 146, designed as screws, are passed through openings 148 of the cover element 104 and bores of the metallic plate 144, in order subsequently to engage in threads 150 of the base element 106, in order to be screwed into said threads. The printed circuit board 124 is fastened on the base element 106 from the side of the base element 106 by screws. During the operation of the first electronic mechanism 140 and the second electronic mechanism 142, heat is produced on the printed circuit board 124. This heat is absorbed by the metallic plate 144 and then passed on to the base element 106 produced from metal via the fastening means 146 designed as screws. The base element 106 is in this case arranged in the motor vehicle in such a way that it undergoes cooling from the outside.

As an alternative to the electronic module 100 shown in FIG. 2, the electronic module 100 according to FIG. 3 may also be able to be connected to the surroundings, in particular to the electrical appliances 122, by means of electrical connection means 110, which are arranged on the outer wall of the cover element 104. The reference numerals in FIG. 3 correspond to those in FIG. 2, As they coincide in this way, you are referred to the description of FIG. 2 for the function of the individual components.

Both the throttle body 10 and the electronic module 100 of FIGS. 1 and 2 to 3 have an especially low space requirement as a result of their especially compact form of construction. Moreover, in the case of the throttle body 10 there is no longer the risk of faulty signal transmissions from the first electronic mechanism 80 of the electric drive 26 of the throttle body 10 to the second electronic mechanism 82 of the electrical appliances 46 of the motor vehicle. The electronic module 100 can be used universally and can be fitted at any desired location in the motor vehicle. It simply has to be ensured in this case, for especially reliable signal transmission, that the connections to the electrical appliances 122 are not all that long.

What is claimed is:

1. A throttle body for an internal combustion engine of a motor vehicle comprising:

a continuous throttle opening for a throttle valve, the opening arranged on a throttle-valve shaft, a housing comprising a housing cover and a housing body, an electric servodrive and a first electronic mechanism arranged within the housing body so as to adjust to throttle-valve shaft, the first electronic mechanism and a second electronic mechanism for electrical appliances arranged outside the housing and in the housing cover, both the first and second electronic mechanisms comprising a control unit, a data acquisition unit and a data storage unit, the first and second electronic mechanisms being arranged such that they can be brought into contact with electrical appliances arranged outside the housing by means of electrical connection means which are at least partially arranged in the housing cover.

2. The throttle body according to claim 1, wherein the electrical appliances are arranged in an internal combustion engine of a motor vehicle.

3. The throttle body according to claim 1, wherein the electrical appliances comprise an ignition device and/or an injection device and/or an oil-level measuring device and/or an air-mass regulating device.

4. The throttle body according to claim 1, wherein the housing cover comprises plastic and the electrical connection means is at least partially embedded in the plastic.

5. The throttle body according to claim 1, wherein both the first electronic mechanism and the second electronic mechanism for the electrical appliances arranged outside the housing are arranged in a region of the housing cover which is bounded by a covering element.

6. The throttle body according to claim 1, wherein the first electronic mechanism and the second electronic mechanism for the electrical appliances arranged outside the housing are arranged on a common printed circuit board in the housing cover.

7. The throttle body as claimed in claim 6, characterized in that the printed circuit board is arranged on a heat-conducting plate such as a metallic plate.

8. The throttle body according to claim 7, wherein the heat-conducting plate is fastened by fastening means both on the housing cover and on the housing body.

9. The throttle body as claimed in claim 8, characterized in that the fastening means are screws which predominantly consist of metal.

10. The throttle body according to claim 1, wherein the housing body comprises a metal such as aluminum.

11. The throttle body according to claim 1, wherein the electric servodrive of the throttle-valve shaft is connected to the first electronic mechanism by means of an electrical plug-in connection.

12. The throttle body according to claim 1, further comprising a restoring spring device for resetting the throttle valve into an emergency position arranged in the housing.

13. The throttle body according to claim 1, further comprising a device for acquiring the position of the throttle-valve shaft arranged in the housing.

14. An electronic module including an electronic mechanism for a motor vehicle and a base element which can be closed by a cover element, the motor vehicle having a multiplicity of electrical appliances and a throttle body, the throttle body comprising a housing with a continuous throttle opening for a throttle valve which is pivotably arranged on a throttle-valve shaft and an electric servodrive, arranged in the housing, the electronic module comprising a first electronic mechanism for the throttle body and a second electronic mechanism for electrical appliances of the motor vehicle arranged in the cover element such that the first electronic mechanism of the throttle body and the second electronic mechanism of the electrical appliances can be connected to the throttle body and the electrical appliances of the internal combustion engine by means of electrical connection means, and the electrical connection means being at least partially arranged in the cover element.

15. The electronic module according to claim 14, wherein the electrical appliances are an ignition device and/or an injection device and/or an oil-level measuring device and/or an air-mass regulating device.

16. The electronic module according to claim 14, wherein the cover element comprises plastic and the electrical connection means are at least partially embedded in the plastic.

17. The electronic module according to claim 14, wherein the first electronic mechanism for the throttle body and the second electronic mechanism for the electrical appliances are arranged on a common printed circuit board in the cover element.

18. The electronic module according to claim 17, wherein the printed circuit board is arranged on a heat-conducting plate such as a metallic plate.

19. The electronic module according to claim 18, wherein the heat-conducting plate is fastened by means for fastening both on the cover element and on the base element.

20. The electronic module according to claim 19, wherein the means for fastening are screws comprising metal.

21. The electronic module according to claim 14, wherein the base element comprises metal.

* * * * *